US011268282B1

(12) United States Patent
Kroneberger

(10) Patent No.: US 11,268,282 B1
(45) Date of Patent: Mar. 8, 2022

(54) GUTTER COVER

(71) Applicant: Jeffrey Todd Kroneberger, Hunt Valley, MD (US)

(72) Inventor: Jeffrey Todd Kroneberger, Hunt Valley, MD (US)

( * ) Notice: Subject to any disclaimer, the term of this patent is extended or adjusted under 35 U.S.C. 154(b) by 0 days.

(21) Appl. No.: 17/070,116

(22) Filed: Oct. 14, 2020

Related U.S. Application Data

(63) Continuation-in-part of application No. 29/747,232, filed on Aug. 20, 2020.

(51) Int. Cl.
*E04D 13/076* (2006.01)
*E04D 13/068* (2006.01)

(52) U.S. Cl.
CPC ..... *E04D 13/076* (2013.01); *E04D 13/068* (2013.01)

(58) Field of Classification Search
CPC .... E04D 13/076; E04D 13/064; E04D 13/068
See application file for complete search history.

(56) References Cited

U.S. PATENT DOCUMENTS 2,271,081 A * 1/1942 Layton ..... E04D 13/076 52/12
3,351,206 A 11/1967 Wennerstrom
3,436,878 A 4/1969 Singer
4,467,570 A * 8/1984 Kriegel ..... E04D 13/076 210/162
4,592,174 A 6/1986 Hileman
4,905,427 A * 3/1990 McPhalen ..... E04D 13/076 210/474
5,375,379 A 12/1994 Meckstroth
5,471,798 A * 12/1995 Kuhns ..... E04D 13/076 52/11
5,557,891 A * 9/1996 Albracht ..... E04D 13/076 52/11
5,660,001 A * 8/1997 Albracht ..... E04D 13/076 52/12
6,016,631 A * 1/2000 Lowrie, III ..... E04D 13/076 52/12
6,098,344 A * 8/2000 Albracht ..... E04D 13/076 52/12
6,412,228 B1 7/2002 Meckstroth
(Continued)

FOREIGN PATENT DOCUMENTS

CA 2541186 A1 * 7/2007 ..... E04D 13/076
CA 2923880 A1 * 4/2015 ..... E04D 13/072
(Continued)

*Primary Examiner* — Jessie T Fonseca
(74) *Attorney, Agent, or Firm* — Nixon & Vanderhye P.C.

(57) ABSTRACT

A cover for a gutter is disclosed. The gutter may have a front section, a rear section, a gutter channel formed between the front section and the rear section, an intermediate flange portion extending from the front section, and an inner flange portion extending from the intermediate flange portion. The cover may include: a main body configured to cover the gutter channel when the cover is secured to the gutter; and a front flange may include: an upper flange portion that extends from the main body and is configured to interlock with the intermediate flange portion to secure the cover to the gutter; a connecting portion that extends from the upper flange portion; and a lower flange portion that extends from the connecting portion and has a free end extending towards the upper flange portion.

22 Claims, 13 Drawing Sheets

(56) References Cited

U.S. PATENT DOCUMENTS

| | | | | |
|---|---|---|---|---|
| 6,786,008 | B2 | 9/2004 | Brochu | |
| 7,104,011 | B1 * | 9/2006 | Knight | E04D 13/076 52/11 |
| 7,627,991 | B1 * | 12/2009 | Feldhaus | E04D 13/076 210/155 |
| 7,765,742 | B2 | 8/2010 | Ealer | |
| 8,276,321 | B2 | 10/2012 | Bell | |
| 8,297,000 | B1 * | 10/2012 | Demartini | E04D 13/076 52/12 |
| 8,316,585 | B2 * | 11/2012 | Brochu | E04D 3/364 52/11 |
| 8,322,082 | B2 | 12/2012 | Neumann | |
| 8,434,269 | B1 * | 5/2013 | Brochu | E04D 13/076 52/12 |
| 8,650,803 | B2 * | 2/2014 | Robins | E04D 13/076 52/12 |
| 9,021,747 | B2 | 5/2015 | Lenney et al. | |
| 9,127,463 | B1 * | 9/2015 | Feldhaus | E04D 13/076 |
| 9,163,406 | B1 * | 10/2015 | Ealer, Sr. | E04D 13/076 |
| D819,790 | S | 6/2018 | Killian | |
| 10,344,482 | B2 | 7/2019 | Brochu | |
| 10,519,667 | B1 * | 12/2019 | Ealer, Sr. | B21D 47/005 |
| 2003/0046876 | A1 | 3/2003 | Higginbotham | |
| 2004/0118052 | A1 | 6/2004 | Brochu | |
| 2005/0166465 | A1 | 8/2005 | Banks et al. | |
| 2006/0107603 | A1 | 5/2006 | Brownridge | |
| 2006/0230687 | A1 * | 10/2006 | Ealer, Sr. | E04D 13/076 52/12 |
| 2009/0320381 | A1 * | 12/2009 | Gerig | E04D 13/076 52/12 |
| 2010/0071273 | A1 * | 3/2010 | Joly, Jr | E04D 13/076 52/12 |
| 2011/0185641 | A1 * | 8/2011 | Snell | E04D 13/076 52/12 |
| 2012/0192502 | A1 * | 8/2012 | Glander | E04D 13/076 52/12 |
| 2013/0326846 | A1 * | 12/2013 | Cullen | E04D 13/068 24/564 |
| 2015/0033638 | A1 * | 2/2015 | Davis | E04D 13/076 52/12 |
| 2015/0089883 | A1 | 4/2015 | Peck et al. | |
| 2017/0058529 | A1 * | 3/2017 | Brochu | E04D 13/076 |
| 2017/0204611 | A1 * | 7/2017 | Brochu | E04D 13/076 |
| 2020/0217074 | A1 * | 7/2020 | Graves | E04D 13/076 |

FOREIGN PATENT DOCUMENTS

| | | | | |
|---|---|---|---|---|
| CA | 3016527 | A1 * | 3/2019 | H02K 21/026 |
| CA | 3023339 | A1 * | 5/2019 | E04D 13/076 |
| GB | 2084210 | A * | 4/1982 | E04D 13/076 |
| WO | 2015/048116 | | 4/2015 | |

* cited by examiner

GUTTER COVER

CROSS-REFERENCE TO RELATED APPLICATIONS

The present application is a continuation-in-part of U.S. Design Application No. 29/747,232, filed Aug. 20, 2020, the entire contents of which are incorporated herein by reference.

BACKGROUND OF THE PRESENT TECHNOLOGY

Gutters that capture and direct water away from roofs may be susceptible to clogging from debris, such as leaves, sticks, and shingles. If the debris is not washed out naturally by rainfall, it can accumulate and prevent water from draining out of the gutter system. That, in turn, can cause excessive rainfall to overflow the gutter and spill down the side of the structure on which the gutter is attached, which may cause water damage to the structure or the ground surrounding it.

The accumulation of debris in gutters can be addressed by actively removing the debris from the gutters, but doing so may be difficult with gutters installed high on the structure. Also, even if the gutters can readily be cleaned, they may be susceptible to becoming clogged again soon after. This may require regular attention that is not convenient.

The accumulation of debris in gutters can also be addressed by preventing debris from entering the gutter in the first place. A cover may be installed on the gutter that prevents the debris from entering the gutter, and may also facilitate the debris being washed away, while allowing water to drain through the debris and the cover and into the gutter to be directed away from the structure.

Covers for gutters, however, have been difficult to install, for example, by requiring a multitude of complex fasteners to secure the cover to the gutter. Thus, installation can be complicated, time consuming, and costly. Even once fastened to the gutter, complex fastening arrangements may not adequately secure the cover. Wind, heavy rain, snow, hail, etc., might dislodge and/or damage the cover, rendering it ineffective. Covers have also been complex, and therefore costly, to produce, for example, having multiple components and being made of different materials in an attempt to be secure and sturdy once installed.

The present technology, as described below, seeks to overcome these deficiencies.

SUMMARY OF THE PRESENT TECHNOLOGY

One aspect of the present technology is directed to a cover for a gutter. The cover may include a main body; and a front flange that includes an upper flange portion that extends from the main body and a lower flange portion that has a free end.

Another aspect of the present technology is directed to a cover for a gutter. The cover may include a main body; and a front flange that includes an upper flange portion that extends from the main body and a lower flange portion that has a free end extending towards the upper flange portion.

Another aspect of the present technology is directed to a cover for a gutter, the gutter having a front section, a rear section, a gutter channel formed between the front section and the rear section, an intermediate flange portion extending from the front section, and an inner flange portion extending from the intermediate flange portion. The cover may include: a main body configured to cover the gutter channel when the cover is secured to the gutter; and a front flange comprising: an upper flange portion that extends from the main body and is configured to contact the intermediate flange portion to secure the cover to the gutter; a connecting portion that extends from the upper flange portion; and a lower flange portion that extends from the connecting portion and has a free end extending towards the upper flange portion, the free end being configured to contact and slide past the inner flange portion to secure the cover to the gutter.

Another aspect of the present technology is directed to a gutter and cover system including a gutter and a cover. The gutter may include: a front section; a rear section; a gutter channel formed between the front section and the rear section; an intermediate flange portion extending from the front section; and an inner flange portion extending from the intermediate flange portion. The cover may include: a main body configured to cover the gutter channel when the cover is secured to the gutter; and a front flange comprising: an upper flange portion that extends from the main body and is configured to contact the intermediate flange portion to secure the cover to the gutter; a connecting portion that extends from the upper flange portion; and a lower flange portion that extends from the connecting portion and has a free end extending towards the upper flange portion, the free end being configured to contact and slide past the inner flange portion to secure the cover to the gutter.

Another aspect of the present technology is directed to a method of manufacturing a cover for a gutter. The method may include: forming a main body; and forming a front flange comprising: forming an upper flange portion that extends from the main body; forming a connecting portion that extends from the upper flange portion; and forming a lower flange portion that extends from the connecting portion and has a free end extending towards the upper flange portion.

Another aspect of the present technology is directed to a method of installing a cover onto a gutter. The method may include: engaging a front flange of the cover to the gutter; engaging an upper flange portion of the cover to an intermediate flange portion of the gutter; and engaging a lower flange portion of the cover to an inner flange portion of the gutter.

In examples of any of the preceding aspects: (a) the upper flange portion and the free end of the lower flange portion may be configured to sandwich the intermediate flange portion and the inner flange portion until the open end of the lower flange portion is slid past the open end of the inner flange portion allowing the lower flange portion to spring upward toward the intermediate flange portion to secure the cover to the gutter, (b) the front flange may be shaped such that the upper flange portion is positioned above the lower flange portion when the cover is secured to the gutter, (c) the upper flange portion may include a flat section that is configured to contact a flat section of the intermediate flange portion, (d) the upper flange portion may be configured to be positioned externally of the gutter channel when the cover is secured to the gutter, (e) the upper flange portion may be configured to contact the intermediate flange portion, (f) the free end may be configured to contact surface of the inner flange portion facing away from the intermediate flange portion, (g) the front flange may be configured to be secured to the gutter without fasteners, (h) the front flange may be configured to be secured to the gutter by a snap fit, a press fit, or an interlocking fit, (i) the main body and the front flange may comprise a single, continuous, and homogeneous piece of material, (j) the upper flange portion may include a leading edge, and the leading edge and the free end of the lower flange portion may extend to at least an approximately equal distance away from the main body, (k) the leading edge may extend farther from the main body than the free end of the lower flange portion, (l) the main body may include a plurality of drainage holes, (m) the main body may include a wavy section, (n) the main body may include a flap and a retaining portion that joins the flap to the main body, the flap and the retaining portion being formed by a cut in the main body, (o) the retaining portion may be deformable to allow the flap to be displaced from the main body to form an access hole through the main body for a tool, (p) the cover may include a rear flange extending from the main body opposite the front flange and configured to contact the rear section of the gutter, the rear flange including a fastening hole configured to receive a fastener to secure the rear flange of the cover to the rear section of the gutter and to secure the gutter and the cover to a structure, and/or (q) the cover may include a rear flange extending from the main body opposite the front flange and configured to contact the rear section of the gutter.

Of course, portions of the aspects may form sub-aspects of the present technology. Also, various ones of the sub-aspects and/or aspects may be combined in various manners and also constitute additional aspects or sub-aspects of the present technology.

DETAILED DESCRIPTION OF THE TECHNOLOGY

Before the present technology is described in further detail, it is to be understood that the technology is not limited to the particular examples described herein, which may vary. It is also to be understood that the terminology used in this disclosure is for the purpose of describing only the particular examples discussed herein, and is not intended to be limiting.

The following description is provided in relation to various examples which may share one or more common characteristics and/or features. It is to be understood that one or more features of any one example may be combinable with one or more features of another example or other examples. In addition, any single feature or combination of features in any of the examples may constitute a further example.

Figure 1A:
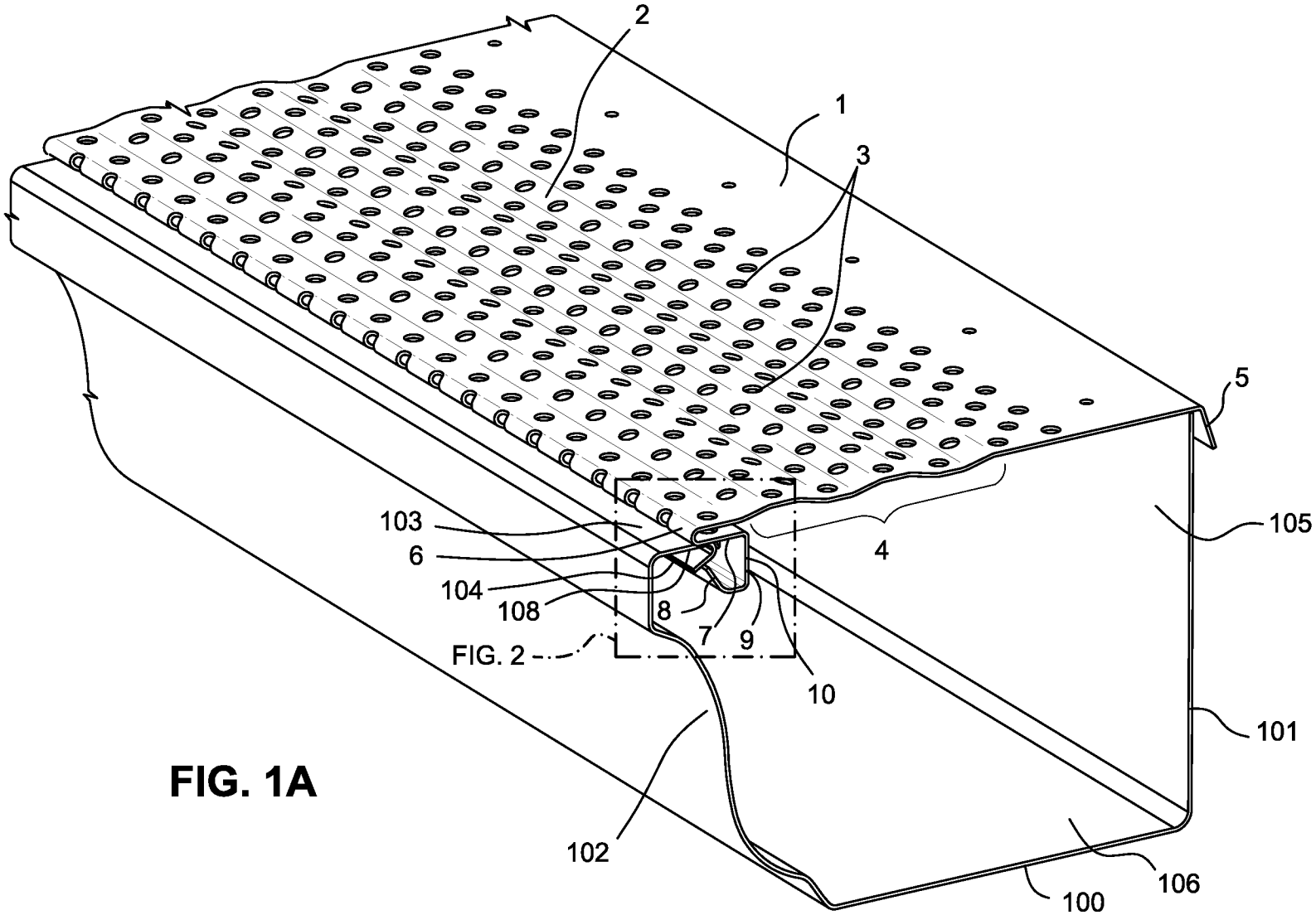
FIG. 1A is a perspective view of a gutter cover, according to an example of the present technology, installed on a gutter.
Figure 1B:
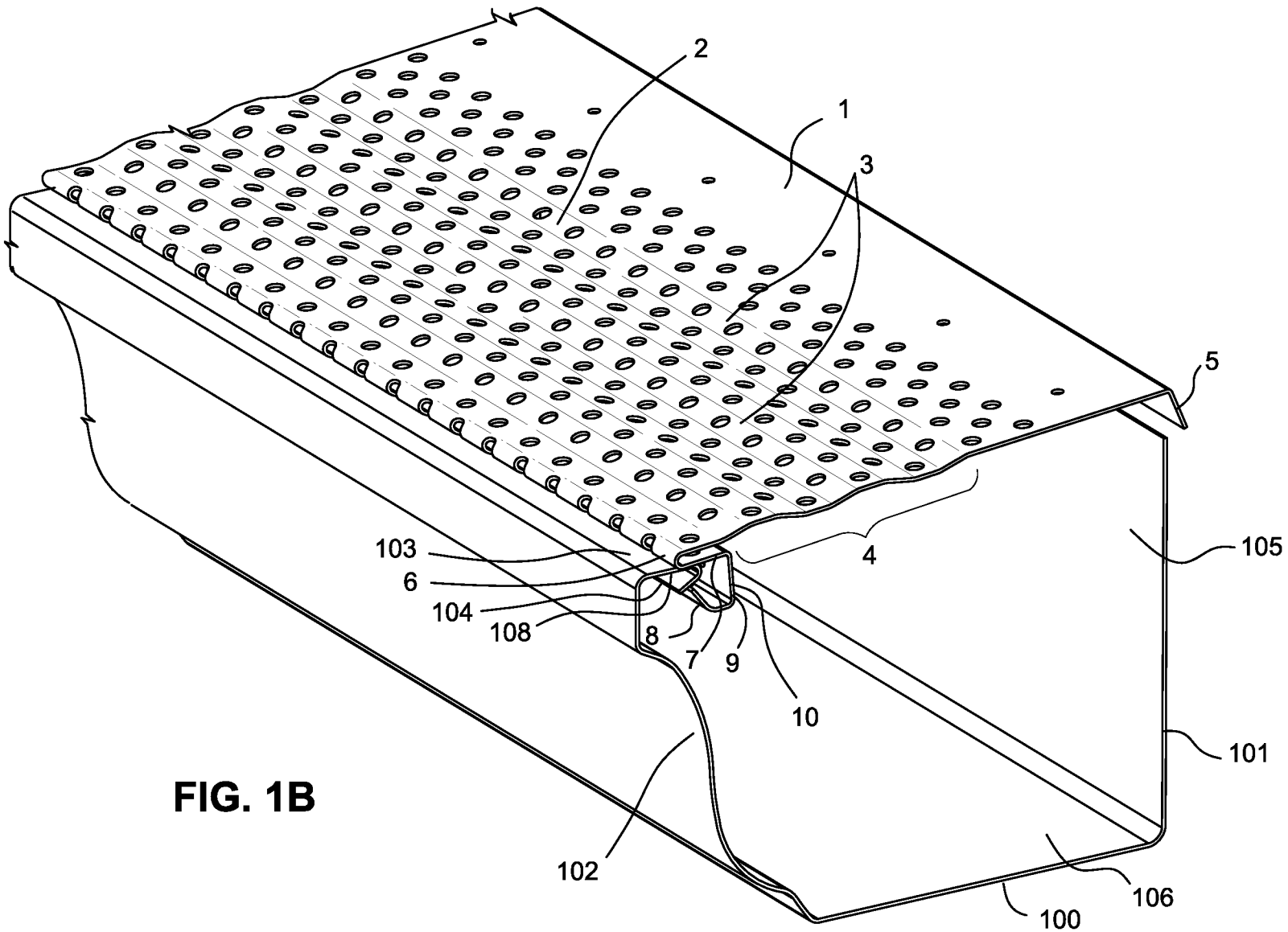
FIG. 1B is a perspective view of a gutter cover, according to an example of the present technology, in an intermediate installation position on a gutter.

The present technology includes a cover 1 that may be installed on a gutter 100 to block debris from entering a gutter channel 106 through a gutter opening 105 formed between a rear section 101 and a front section 102 of the gutter 100. FIG. 1A shows the cover 1, according to an example of the present technology, installed on the gutter 100, and FIG. 1B shows an intermediate installation position of the cover 1 on the gutter 100 in which a front flange 10 of the cover 1 is partially engaged with an intermediate flange portion 108 and an inner flange portion 104 of the gutter 100.

The cover 1 may include a main body 2 that covers the gutter opening 105 to prevent debris from entering the gutter channel 106, while allowing water to drain through drainage holes 3 in the main body 2 and into the gutter channel 106 to be directed away by the gutter 100. The main body 2 may also include a wavy section 4 in which the main body 2 undulates to suspend debris above the drainage holes 3 to prevent debris from accumulating on top of the cover 1 and occluding the drainage holes 3.

The cover 1 may also include a front flange 10 that extends from the main body 2. In examples where the wavy section 4 is included, the front flange 10 may extend from the wavy section 4. The front flange 10 may include a leading edge 6, shown in the form of a fold in the depicted examples.

An upper flange portion 7 may extend from the leading edge 6. The upper flange portion 7, in the examples shown in FIGS. 1A-2 and 7A-7C, may be positioned adjacent to or contact an upper surface 103 of the intermediate flange portion 108 to support the cover 1 on top of the gutter 100 at the front side, i.e., away from the structure. The upper flange portion 7 may be positioned externally over the gutter channel 106 when the cover 1 is installed on the gutter 100. In these depicted examples, the upper flange portion 7 and the intermediate flange portion 108 each form an at least partly flat surface overlapping each other. In further examples, the entire upper flange portion 7 and the entire intermediate flange portion 108 may be flat. In still further examples, at least a portion of the upper flange portion 7 may overlap the entire intermediate flange portion 108 or at least a portion of the intermediate flange portion 108 may overlap the entire upper flange portion 7. In still further examples, the entire upper flange portion 7 may overlap the entire intermediate flange portion 108.

A connecting portion 9 may extend from the upper flange portion 7 in a downward direction, i.e., away from the main body 2. When the cover 1 is installed on the gutter 100, the connecting portion 9 may extend into the gutter channel 106, as shown in FIGS. 1A-2 and 7A-7C. The connecting portion 9 may be oriented perpendicular, or at least approximately perpendicular, to one or both of the upper flange portion 7 and the main body 2.

Figure 2:
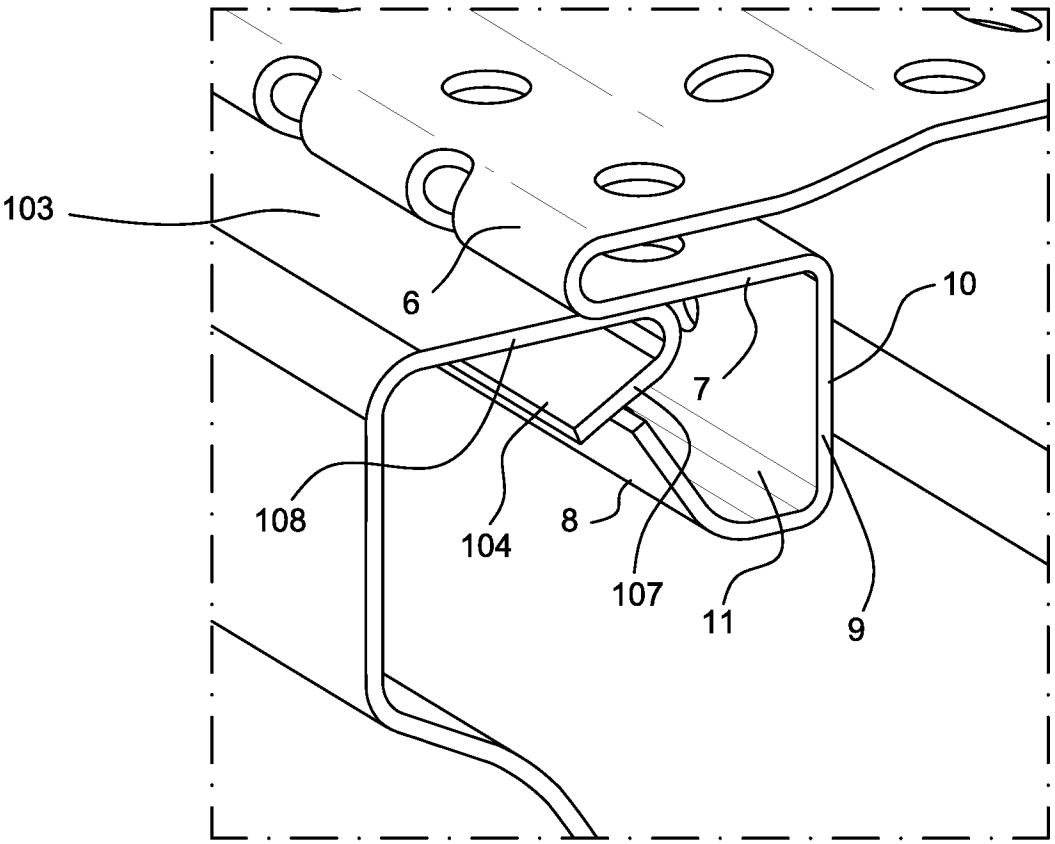
FIG. 2 is a detailed view of FIG. 1A showing the gutter cover installed on the gutter.
Figure 3:
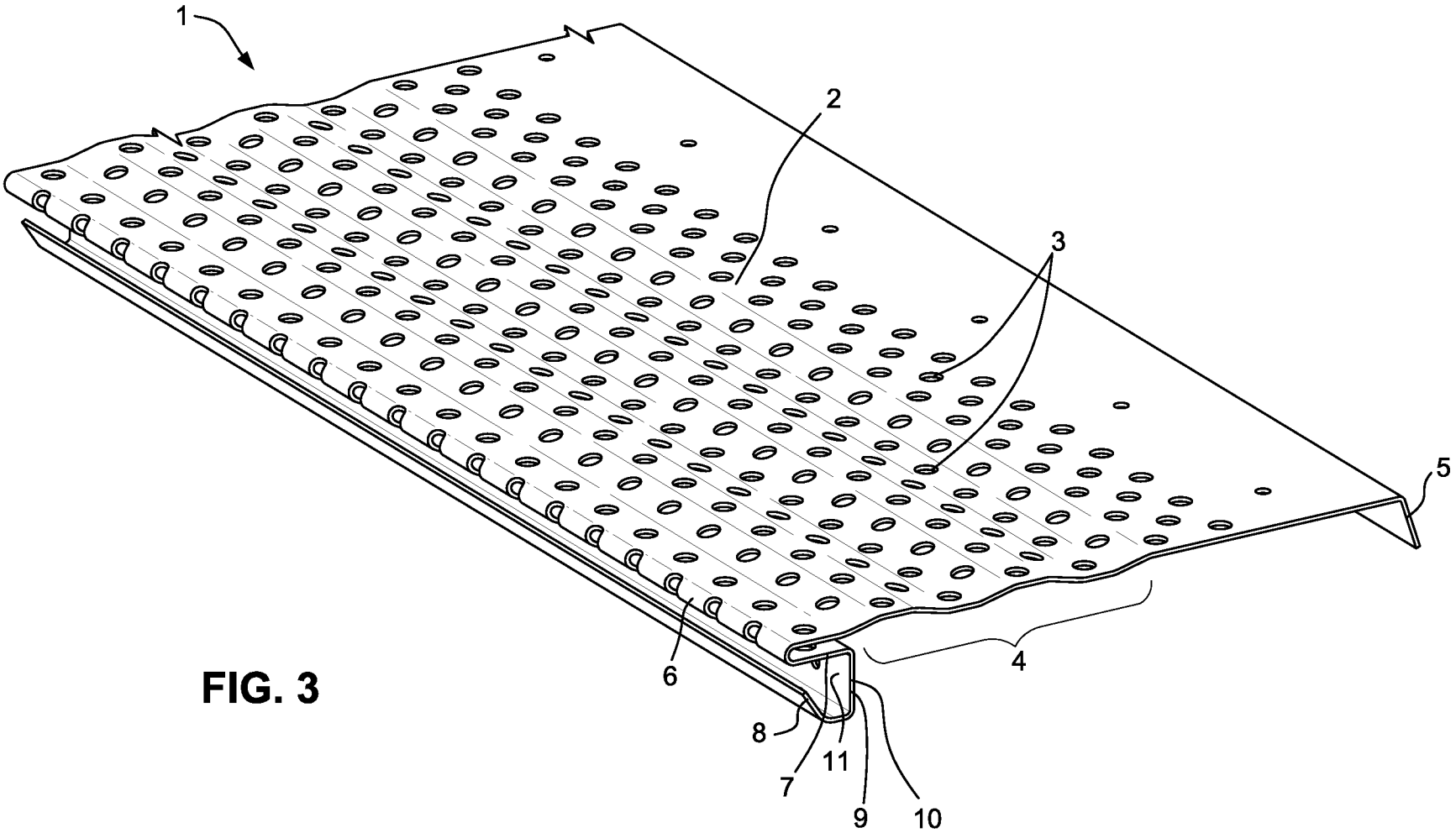
FIG. 3 is a top perspective view of a gutter cover according to an example of the present technology.
Figure 4:
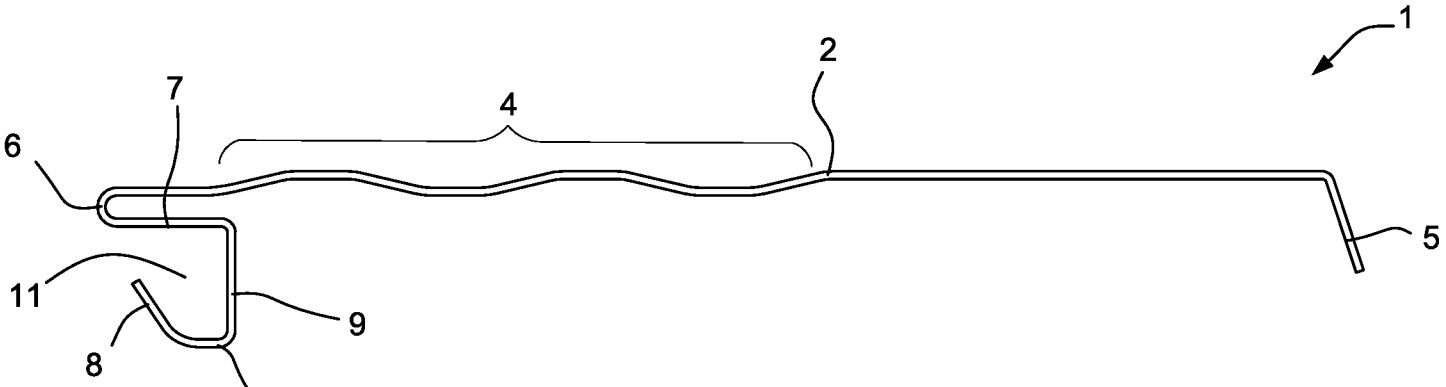
FIG. 4 is an elevation view of a gutter cover according to an example of the present technology.
Figure 5:
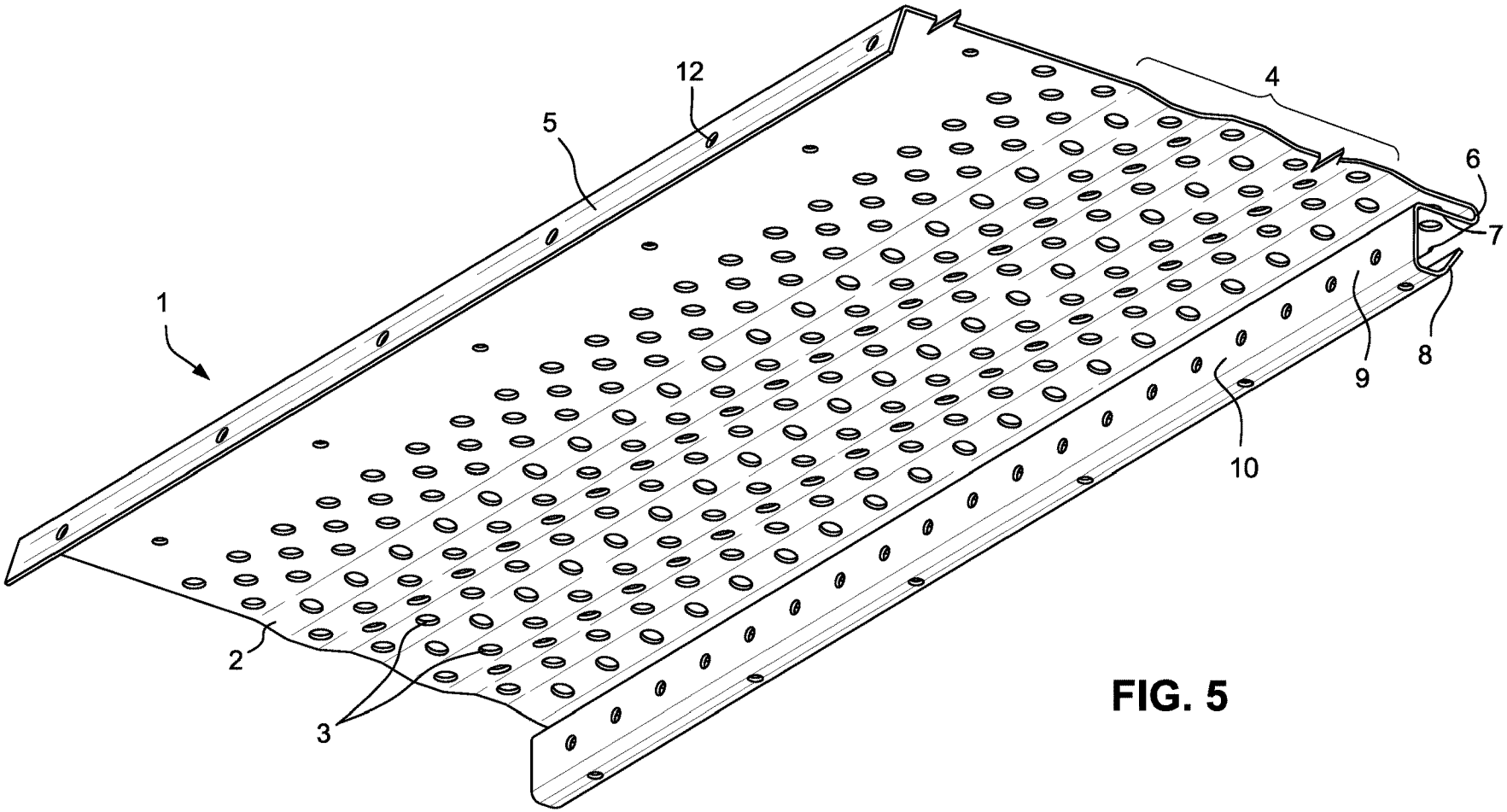
FIG. 5 is a bottom perspective view of a gutter cover according to an example of the present technology.
Figure 6:
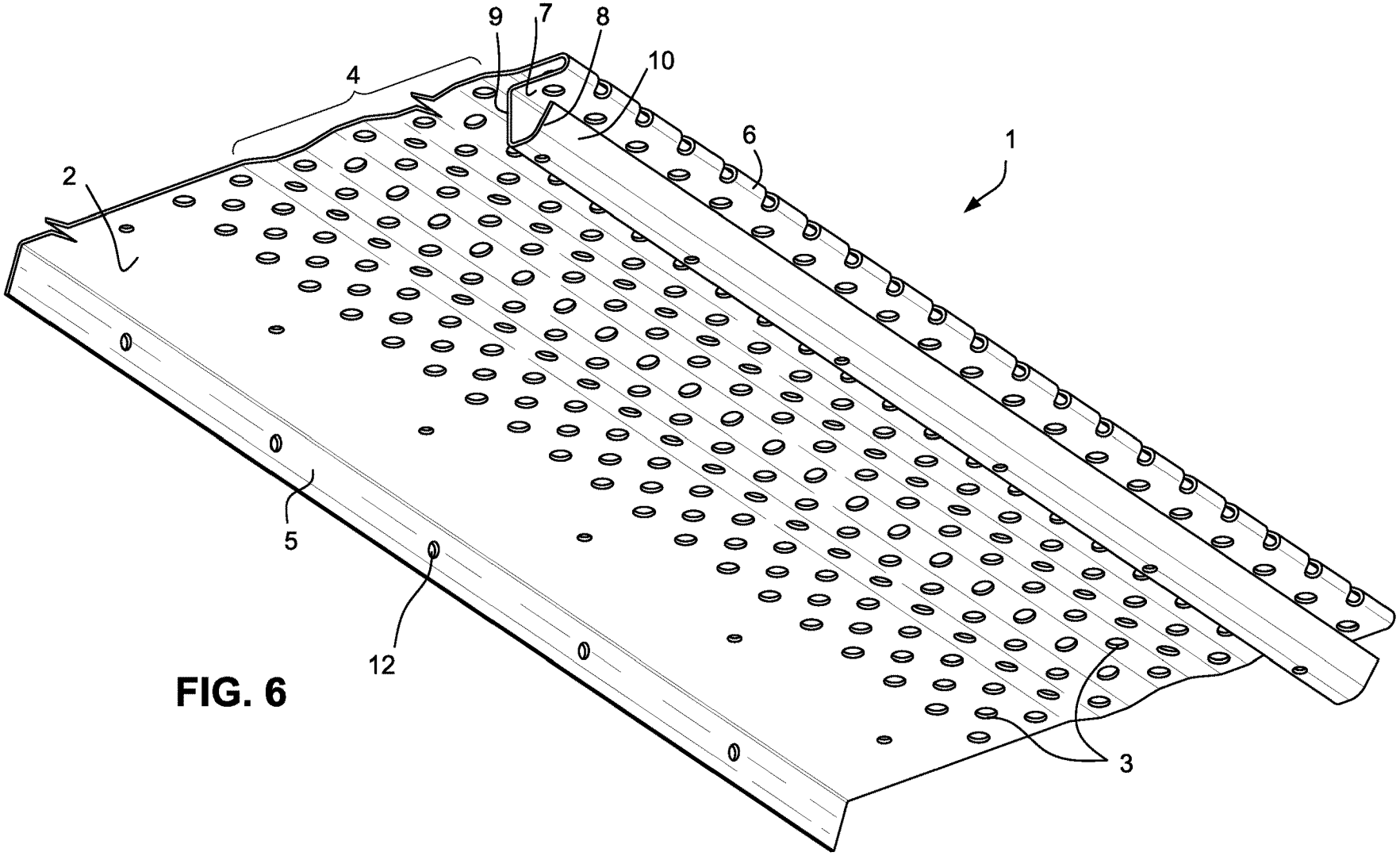
FIG. 6 is another bottom perspective view of a gutter cover according to an example of the present technology.
Figure 7A:
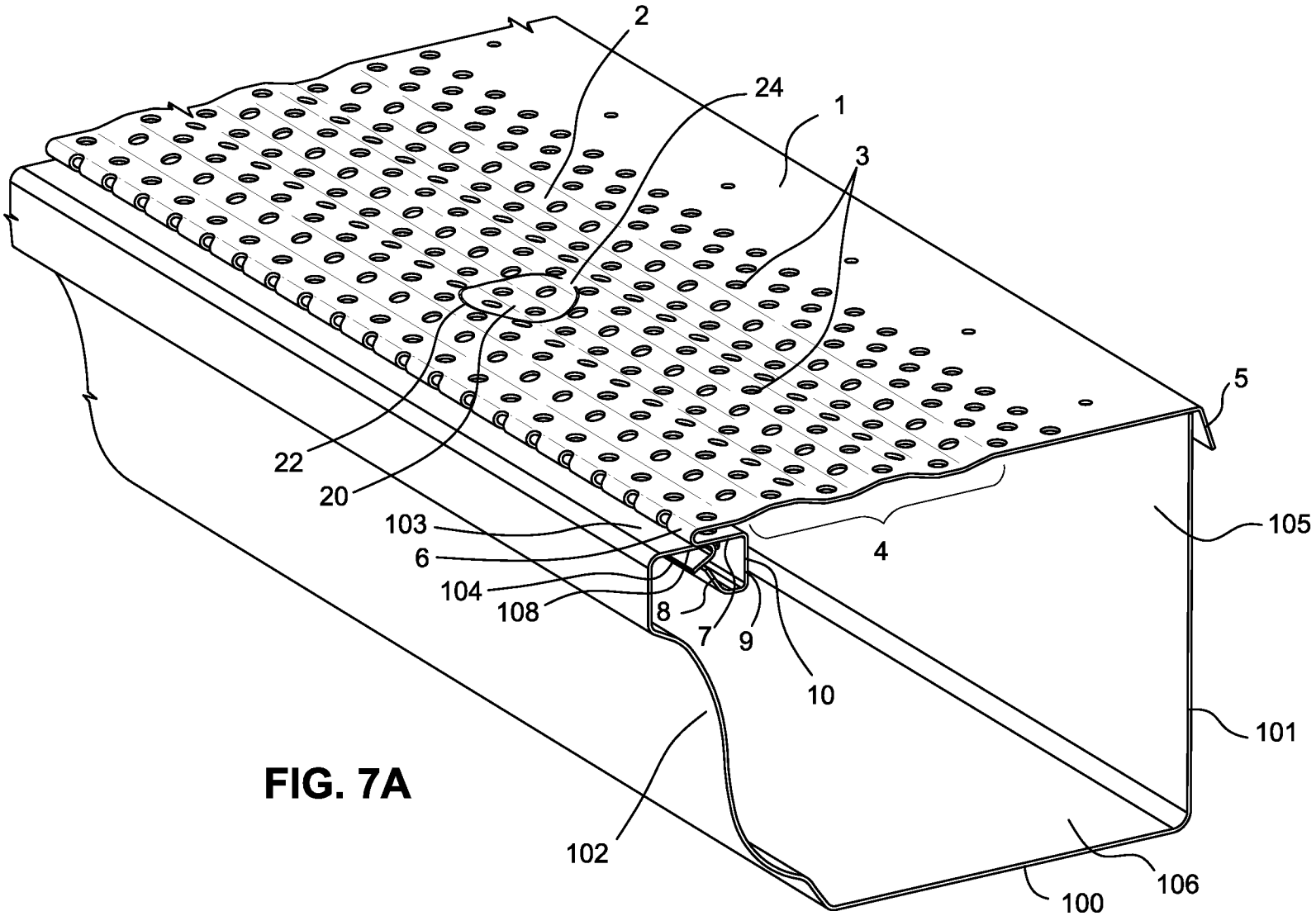
FIG. 7A is a perspective view of a gutter cover, according to another example of the present technology, installed on a gutter.
Figure 7B:
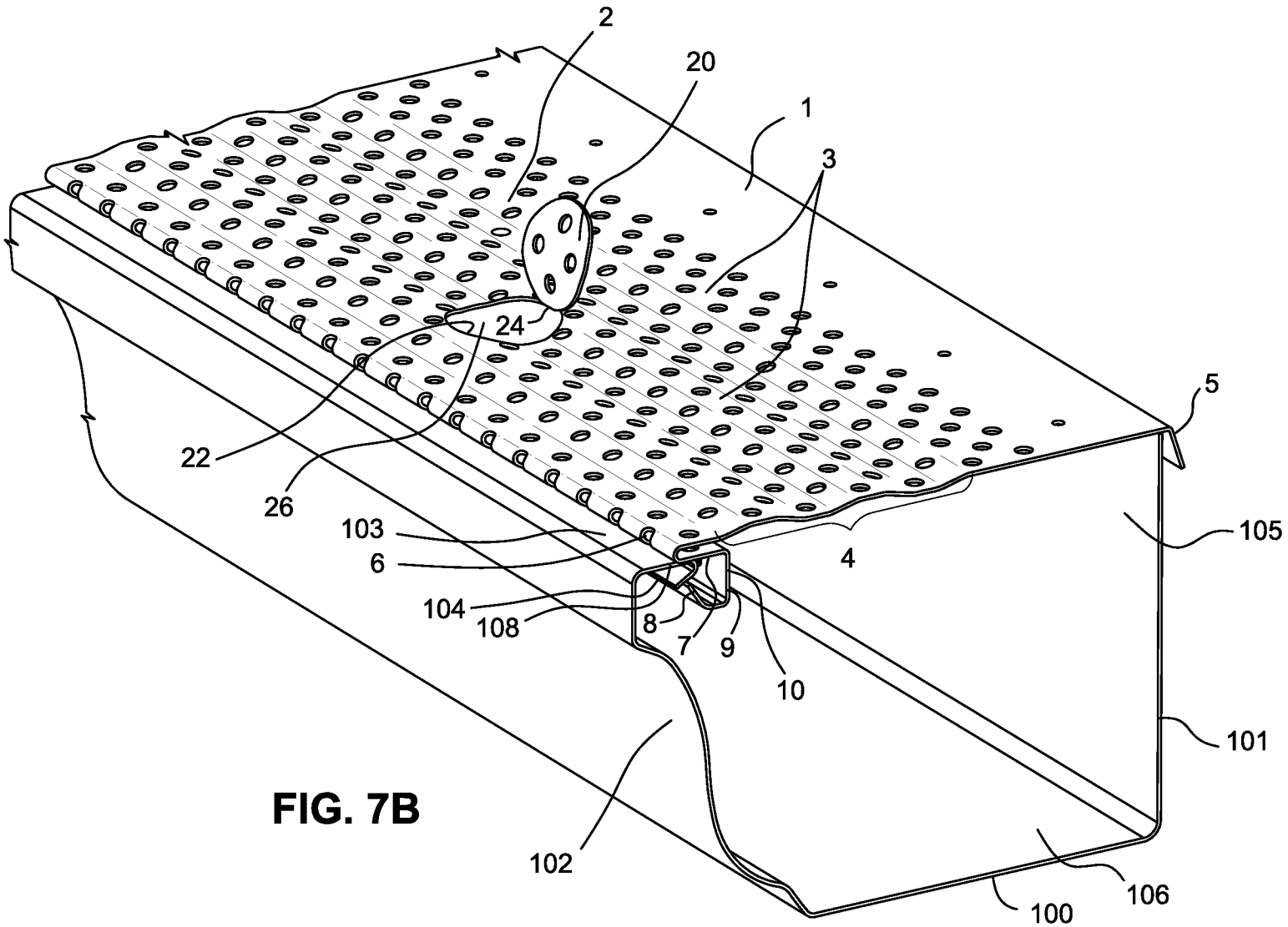
FIG. 7B is a perspective view of a gutter cover, according to another example of the present technology, installed on a gutter with a flap displaced.
Figure 7C:
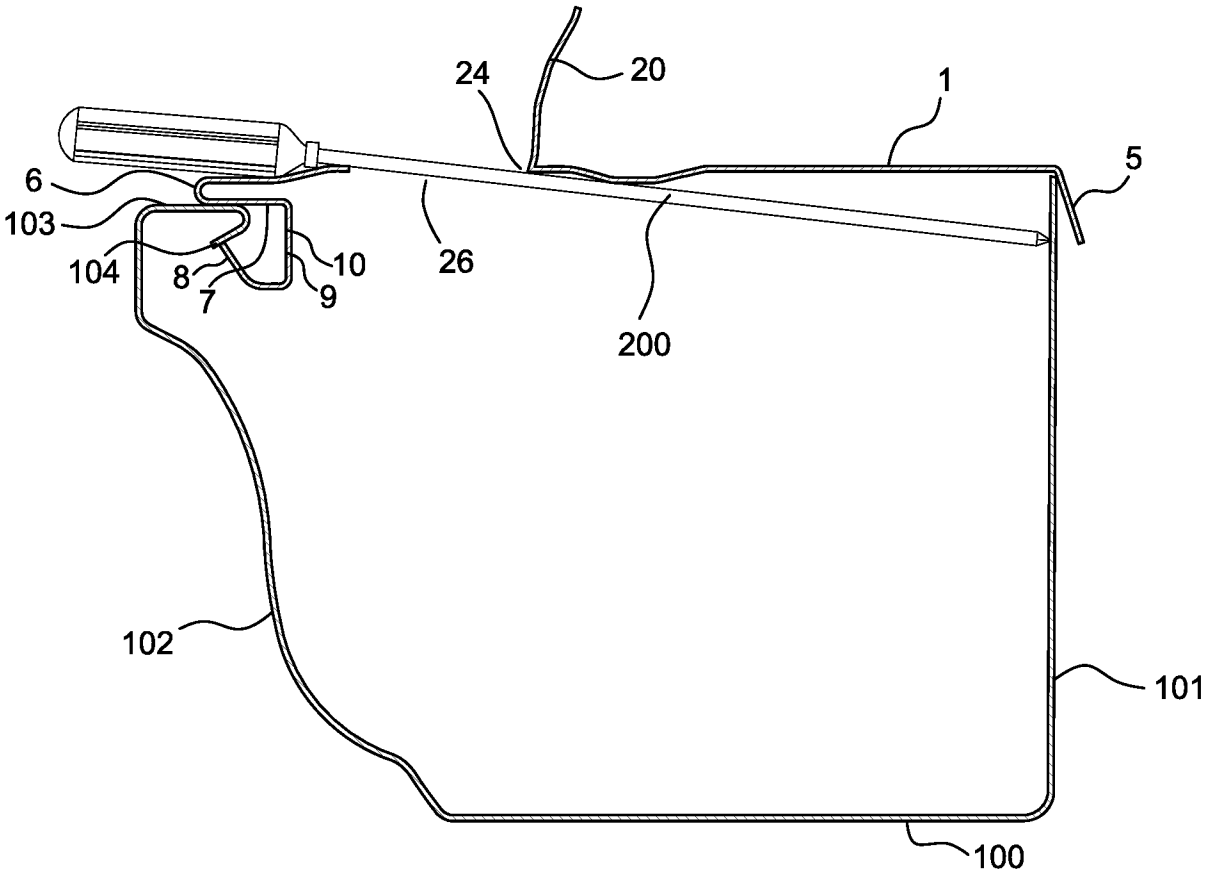
FIG. 7C is an elevation view of a gutter cover, according to another example of the present technology, installed on a gutter with a flap displaced to allow insertion of a tool.
Figure 8:
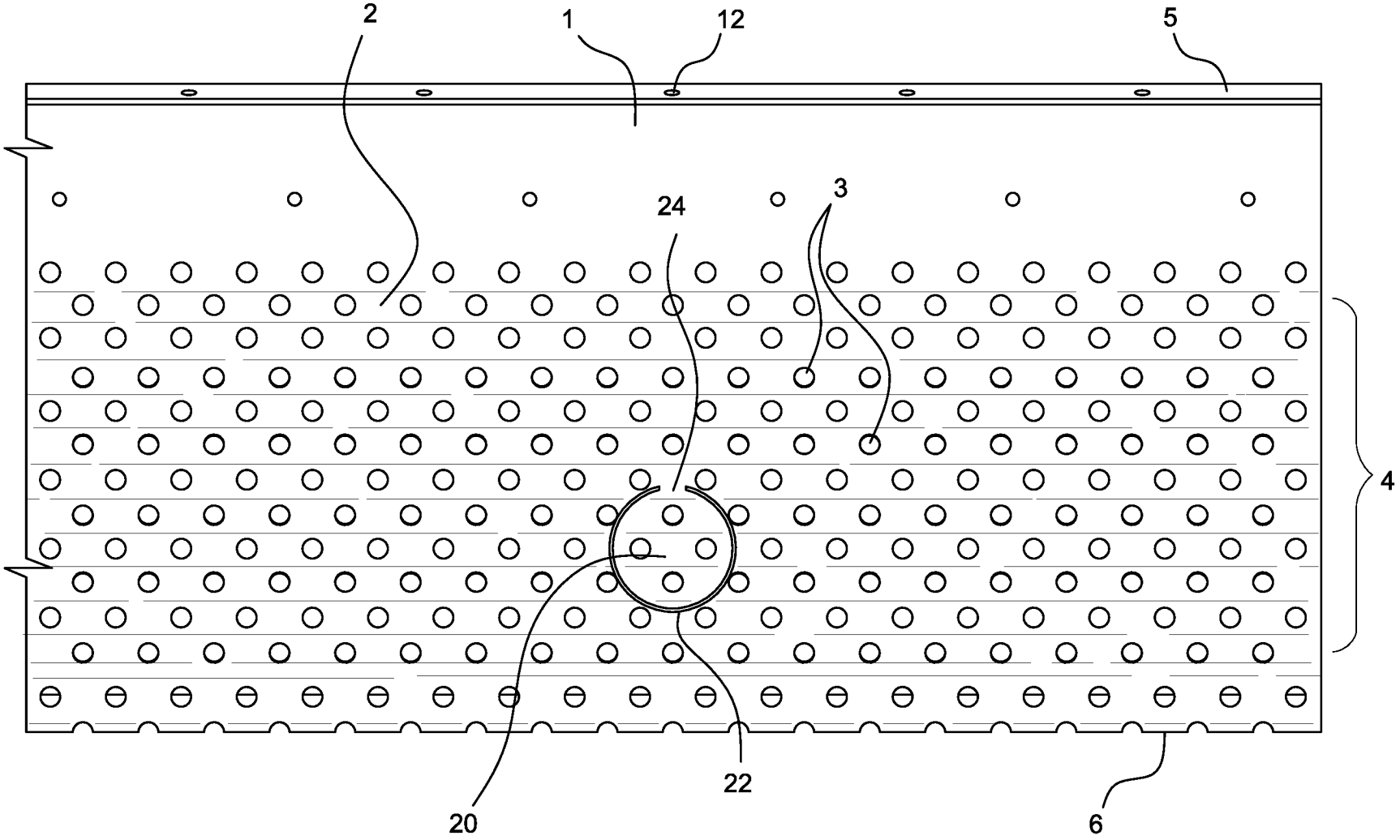
FIG. 8 is a top view of a gutter cover according to another example of the present technology.
Figure 9:
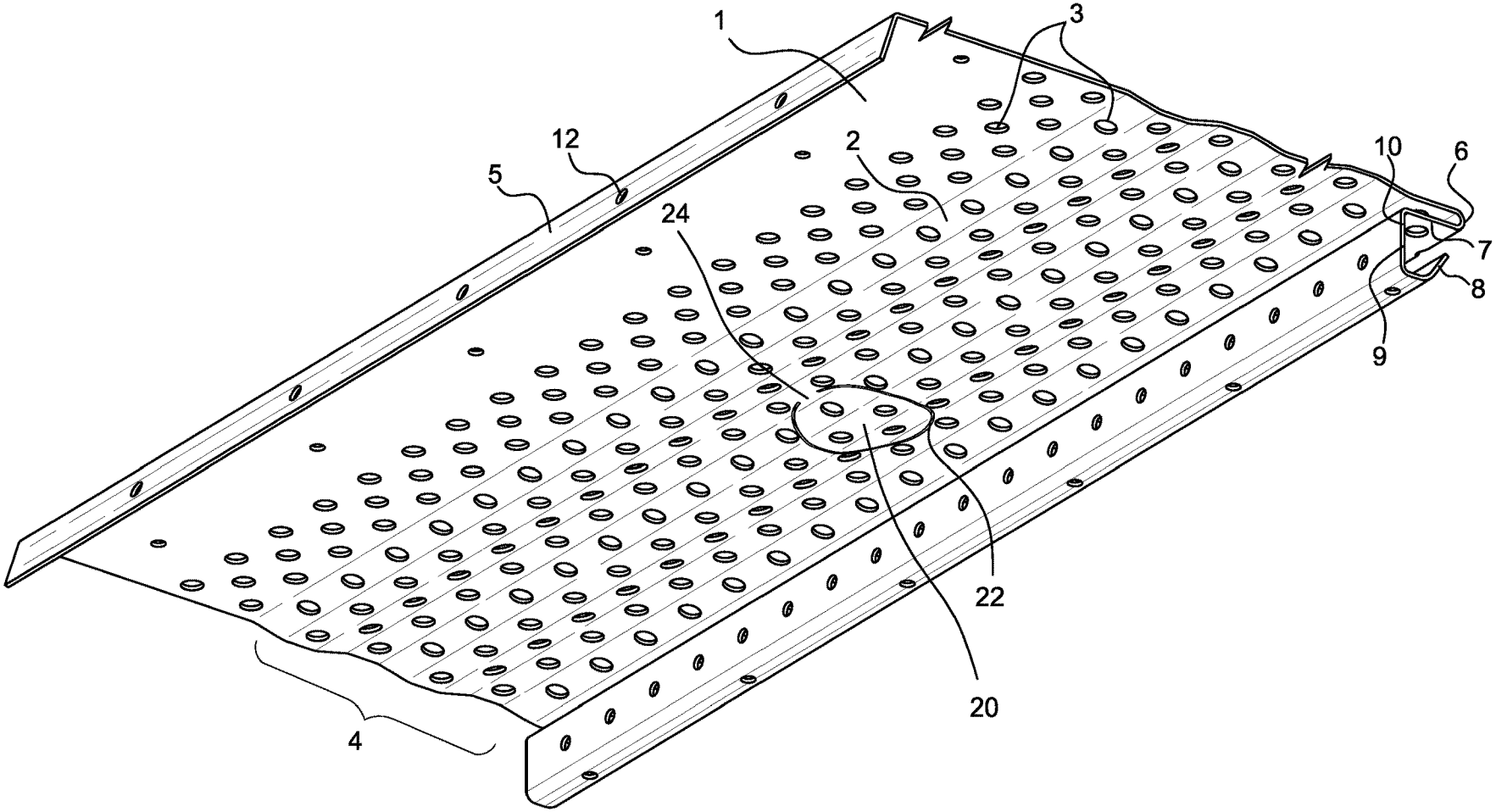
FIG. 9 is a bottom perspective view of a gutter cover according to another example of the present technology.
Figure 10:
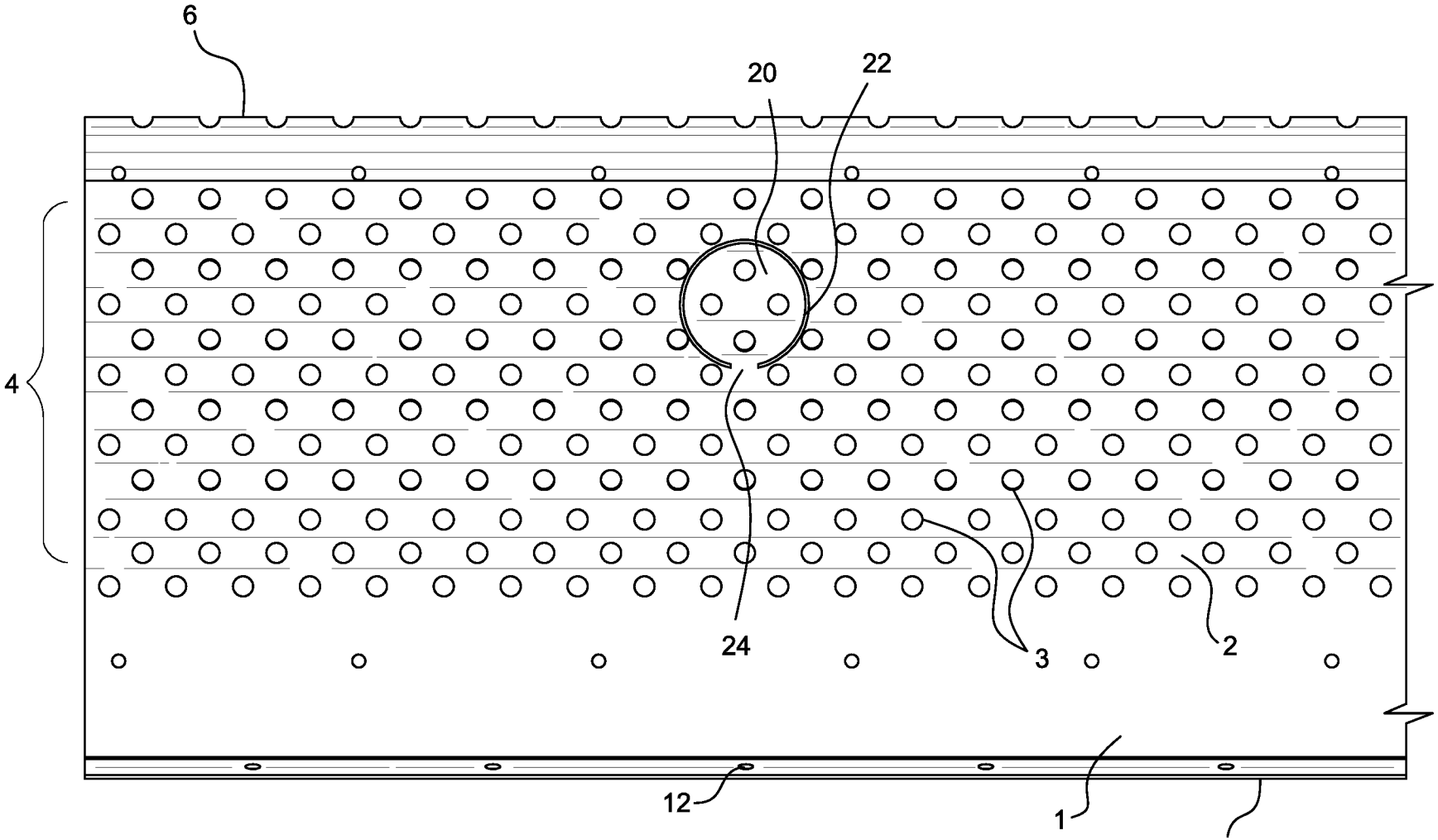
FIG. 10 is a bottom view of a gutter cover according to another example of the present technology.

A lower flange portion 8, which can be seen, for example, in FIG. 2, may extend from the connecting portion 9 to a free end. The lower flange portion 8, and/or its free end, may be positioned adjacent to or in contact with an interior-facing surface 107 of the inner flange portion 104. In an example, such as what FIG. 4 shows, the lower flange portion 8 may extend in a direction that approximately to the leading edge 6. FIG. 4, for example, also shows the lower flange portion 8 extending in a direction that leads away from the connecting portion 9 and at angle that is between perpendicular to the connecting portion 9 and parallel to the connecting portion 9. In further examples, the lower flange portion 8 may be oriented at angle of approximately 30°-45° relative to the connecting portion 9.

FIG. 4 shows that the leading edge 6 extends farther in a forward direction, i.e., away from the structure when the cover 1 is installed on the gutter 100, than the lower flange portion 8. This arrangement may ensure that a sufficient portion of the upper flange portion 7 overlaps the intermediate flange portion 108 to support the cover 1 on top of the gutter 100.

During the installation of the cover 1 to the gutter 100 the cover 1 may be moved forward, or away from the structure. The free end of the lower flange 8 will move downward away from the upper flange 7 as the free end of the inner flange 104 is in a fixed position at a downward angle of approximately 30° from the upper flange 7 and intermediate flange 108.

As the cover 1 is moved forward, or away from the structure during installation the connecting portion 9 will bow as lower flange 8 moves downward and slides along the bottom face of the inner flange 104.

As the cover 1 is moved forward, or away from the structure during installation, the open end of the lower flange 8 will pass the open end of the inner flange 104 allowing the lower flange 8 to spring upward toward the intermediate flange 108 and to its resting position, hence locking the cover 1 to the gutter 100 without the use of mechanical fasteners.

The cover 1 may also include a rear flange 5 that extends from the main body 2 at an opposite side from the front flange 10. The rear flange 5 may be positioned between the rear section of the gutter 100 and the structure when the cover 1 is installed on the structure. The rear flange 5 may be positioned outside of the gutter channel 106 when the cover 1 is installed on the gutter 100. The rear flange 5 may also include fastening holes 12 that allow fasteners, such as screws or nails, to be driven therethrough to secure the cover 1 to the gutter 100 and to secure the gutter 100 to the structure. The rear flange 5 may be omitted in some examples as well, and in that case the main body 2 will simply sit on top of the rear section 101 of the gutter 100. In further examples, with or without the rear flange 5, the cover 1 may be secured to the gutter 100 without fasteners. Additionally, the front flange 10 of the cover 1 may be secured to the gutter 100 by a snap fit, a press fit, or an interlocking fit.

FIGS. 7A-10 show a further example of the cover 1 in which a flap 20 is formed in the main body 2 of the cover 1 by making a cut 22 through a portion of the main body 2 leaving only a portion of the main body 2 material uncut to form a retaining portion 24. This arrangement allows the flap 20 to be displaced from the main body 2, e.g., by bending or deforming the retaining portion 24, upwards or downwards to open an access hole 26 through the main body 2. The installer can then insert a tool 200 and a fastener through the access hole to secure the rear flange 5 of the cover 1 to the gutter 100 to secure gutter 100 to the structure. Once the fastener is secured, the tool 200 is removed and the retaining portion 24 is bent again to position the flap 20 back into the access hole 26 to close off the access hole 26.

The cover 1 may include a series of flaps 20 positioned along the main body 2 in a longitudinal direction. Each flap 20, and therefore each access hole 26, may be aligned with a corresponding fastening hole 12. Each flap 20, and therefore each access hole 26, may be positioned, sized, and shaped to allow the installer to access multiple fastening holes 12 through a single access hole 26.

The flaps 20 may be formed on the wavy section 4 in some examples. Each flap 20 may also include one or more drainage holes 3 or may include no drainage holes 3. Although the flap 20, and therefore the access hole 26, is shown with a circular shape in the depicted examples, it should be understood that other shapes are possible, such as square, rectangular, triangular, oval, and elliptical.

The cover 1 may be constructed from single piece of homogeneous material. The material may be metal, e.g., corrosion-resistant alloys such as stainless steel or an aluminum alloy, or a polymer, such as plastic. The cover 1 may also be constructed from multiple different materials. For example, the main body 2 may include a mesh screen affixed thereto. The mesh screen may be made from stainless steel or a polymer, and it may be affixed to the cover 1 by welding or cementing. The cover 1 may have a uniform thickness. The cover 1 may vary in thickness, alternatively. As can be seen in the depicted examples, the wavy section 4, the front flange 10, and the rear flange 5 of the cover 1 are formed by folding or bending the material, and the material may have an increased or decreased thickness at the folds or bends.

The cover 1 may be formed by a roll-forming process whereby flat sheet stock is fed into a roll-forming machine that incrementally adds bends to the cover 1 to form features such as the wavy section 4, the front flange 10, and the rear flange 5. This process may be used to manufacture the cover 1 in sections of predetermined length. Alternatively, for custom installations the roll-forming machine and the sheet stock may be brought to the structure and roll-formed on-site to desired lengths for each piece of cover 1 to be installed on each corresponding section of gutter 100.

To install the cover 1 on the gutter 100, the upper flange portion 7 may first be engaged with the intermediate flange portion 108 such that the main body 2 is tilted relative to the gutter 100, e.g., as shown in FIG. 1B. In this position, the rear flange 5, if included, may not yet be engaged with the rear section 101 of the gutter 100. Next, the main body 2 of the cover 1 may be tilted downwards so that the lower flange portion 8 engages the inner flange portion 104, and the rear flange 5 may also be engaged with the rear section 101 of the gutter 100, as shown in FIG. 1A. As the cover is tilted into position, the front flange 10 may snap onto the intermediate flange portion 108 and the inner flange portion 104 by engagement of the lower flange portion 8 to the inner flange portion 104 to press the intermediate flange portion 108 against the upper flange portion 7. The example of the cover 1 shown in FIGS. 7A-10 may be installed similarly, except that after the cover 1 is attached to the gutter 100, the cover 1 may be further secured by fasteners when a new gutter 100 and cover 1 system is installed on the structure, as described above.

Unless the context clearly dictates otherwise and where a range of values is provided, it is understood that each intervening value, to the tenth of the unit of the lower limit, between the upper and lower limit of that range, and any other stated or intervening value in that stated range is encompassed within the technology. The upper and lower limits of these intervening ranges, which may be independently included in the intervening ranges, are also encompassed within the technology, subject to any specifically excluded limit in the stated range. Where the stated range includes one or both of the limits, ranges excluding either or both of those included limits are also included in the technology.

Furthermore, where a value or values are stated herein as being implemented as part of the technology, it is understood that such values may be approximated, unless otherwise stated, and such values may be utilized to any suitable significant digit to the extent that a practical technical implementation may permit or require it.

Although the technology herein has been described with reference to particular examples, it is to be understood that these examples are merely illustrative of the principles and applications of the technology. In some instances, the terminology and symbols may imply specific details that are not required to practice the technology. For example, although the terms "first" and "second" may be used, unless otherwise specified, they are not intended to indicate any order but may be utilized to distinguish between distinct elements. Furthermore, although process steps in the methodologies may be described or illustrated in an order, such an ordering is not required. Those skilled in the art will recognize that such ordering may be modified and/or aspects thereof may be conducted concurrently or even synchronously.

It is therefore to be understood that numerous modifications may be made to the illustrative examples and that other arrangements may be devised without departing from the spirit and scope of the technology.

REFERENCE SIGNS LIST

| | |
|---|---|
| gutter cover | 1 |
| main body | 2 |
| drainage hole | 3 |
| wavy section | 4 |
| rear flange | 5 |
| leading edge | 6 |
| upper flange portion | 7 |
| lower flange portion | 8 |
| connecting portion | 9 |
| front flange | 10 |
| front flange channel | 11 |
| fastening hole | 12 |
| flap | 20 |
| cut | 22 |
| retaining portion | 24 |
| access hole | 26 |
| gutter | 100 |
| rear section | 101 |
| front section | 102 |
| upper surface | 103 |
| inner flange portion | 104 |
| gutter opening | 105 |
| gutter channel | 106 |
| interior-facing surface | 107 |
| intermediate flange portion | 108 |
| tool | 200 |

The invention claimed is:

1. A cover for a gutter, the gutter having a front section, a rear section, a gutter channel formed between the front section and the rear section, an intermediate flange portion extending from the front section, and an inner flange portion extending from the intermediate flange portion, the cover comprising:

a main body configured to cover the gutter channel when the cover is secured to the gutter; and a front flange comprising:

an upper flange portion that extends from the main body and is configured to contact the intermediate flange portion to secure the cover to the gutter, the upper flange portion including a leading edge that extends in a direction opposite the main body relative to the upper flange portion;

a connecting portion that extends from the upper flange portion; and a lower flange portion that extends from a side of the connecting portion opposite the main body and has a free end that extends towards the leading edge from the side of the connecting portion opposite the main body, the free end being configured to contact the inner flange portion to secure the cover to the gutter.

2. The cover of claim 1, wherein the inner flange portion and the intermediate flange portion form a first open end, wherein the upper flange portion and the lower flange portion form a second open end, and wherein the upper flange portion and the free end of the lower flange portion are configured to sandwich the intermediate flange portion and the inner flange portion until the second open end of the lower flange portion is slid past the first open end allowing the lower flange portion to spring upward toward the intermediate flange portion to secure the cover to the gutter.

3. The cover of claim 1, wherein the front flange is shaped such that the upper flange portion is positioned above the lower flange portion when the cover is secured to the gutter.

4. The cover of claim 1, wherein the upper flange portion includes a flat section that is configured to contact a flat section of the intermediate flange portion.

5. The cover of claim 1, wherein the upper flange portion is configured to be positioned externally of the gutter channel when the cover is secured to the gutter.

6. The cover of claim 1, wherein the upper flange portion is configured to contact the intermediate flange portion.

7. The cover of claim 1, wherein the free end is configured to contact a surface of the inner flange portion facing away from the intermediate flange portion.

8. The cover of claim 1, wherein the front flange is configured to be secured to the gutter without fasteners.

9. The cover of claim 1, wherein the front flange is configured to be secured to the gutter by a snap fit, a press fit, or an interlocking fit.

10. The cover of claim 1, wherein the main body and the front flange comprise a single, continuous, and homogeneous piece of material.

11. The cover of claim 1, wherein the leading edge and the free end of the lower flange portion extend to at least an approximately equal distance away from the main body.

12. The cover of claim 11, wherein the leading edge extends farther from the main body than the free end of the lower flange portion.

13. The cover of claim 1, wherein the main body includes a plurality of drainage holes.

14. The cover of claim 1, wherein the main body includes a wavy section.

15. The cover of claim 1, wherein the main body includes a flap and a retaining portion that joins the flap to the main body, the flap and the retaining portion being formed by a cut in the main body.

16. The cover of claim 15, wherein the retaining portion is deformable to allow the flap to be displaced from the main body to form an access hole through the main body for a tool.

17. The cover of claim 16, wherein the cover includes a rear flange extending from the main body opposite the front flange and configured to contact the rear section of the gutter, the rear flange including a fastening hole configured to receive a fastener to secure the rear flange of the cover to the rear section of the gutter and to secure the gutter and the cover to a structure.

18. The cover of claim 1, wherein the cover includes a rear flange extending from the main body opposite the front flange and configured to contact the rear section of the gutter.

19. The cover of claim 1, wherein the connecting portion extends from the upper flange portion at a location that is spaced towards the main body from the leading edge.

20. The cover of claim 1, wherein a distance between the leading edge and the free end is less than a length of the connecting portion.

21. A gutter and cover system comprising:

a gutter comprising:

a front section;

a rear section;

a gutter channel formed between the front section and the rear section;

an intermediate flange portion extending from the front section; and an inner flange portion extending from the intermediate flange portion; and a cover comprising:

a main body configured to cover the gutter channel when the cover is secured to the gutter; and a front flange comprising:

an upper flange portion that extends from the main body and is configured to contact the intermediate flange portion to secure the cover to the gutter, the upper flange portion including a leading edge that extends in a direction opposite the main body relative to the upper flange portion;

a connecting portion that extends from the upper flange portion; and a lower flange portion that extends from a side of the connecting portion opposite the main body and has a free end that extends towards the leading edge from the side of the connecting portion opposite the main body, the free end being configured to contact and slide past the inner flange portion to secure the cover to the gutter.

22. A method of manufacturing a cover for a gutter, the gutter having a front section, a rear section, a gutter channel formed between the front section and the rear section, an intermediate flange portion extending from the front section, and an inner flange portion extending from the intermediate flange portion, the method comprising:

forming a main body configured to cover the gutter channel when the cover is secured to the gutter; and forming a front flange comprising:

forming an upper flange portion that extends from the main body and is configured to contact the intermediate flange portion to secure the cover to the gutter, the upper flange portion including a leading edge that extends in a direction opposite the main body relative to the upper flange portion;

forming a connecting portion that extends from the upper flange portion; and forming a lower flange portion that extends from a side of the connecting portion opposite the main body and has a free end that extends towards the leading edge from the side of the connecting portion opposite the main body, the free end being configured to contact and slide past the inner flange portion to secure the cover to the gutter.

* * * * *